US005088256A

United States Patent [19]

Face, Jr.

[11] Patent Number: 5,088,256

[45] Date of Patent: Feb. 18, 1992

[54] CONCRETE JOINT WITH SPRING CLIP RETAINED INSERT AND BOTTOM SEAL

[75] Inventor: Samuel A. Face, Jr., Norfolk, Va.

[73] Assignee: Face Construction Technologies, Inc., Norfolk, Va.

[21] Appl. No.: 562,908

[22] Filed: Aug. 6, 1990

[51] Int. Cl.[5] ..... E01C 11/02; E01C 11/04

[52] U.S. Cl. ..... 52/396; 52/741; 52/573; 404/64; 404/68; 404/74

[58] Field of Search ..... 404/65, 66, 67, 68, 404/69, 49, 74; 52/406, 573, 396, 741

[56] References Cited

U.S. PATENT DOCUMENTS

| | | | |
|---|---|---|---|
| 2,319,949 | 5/1943 | Robertson | 404/67 |
| 3,385,017 | 5/1968 | Williams | 52/396 |
| 3,528,733 | 5/1971 | Hurst | 52/396 |
| 4,346,542 | 8/1982 | Tatend | 404/68 |
| 4,563,850 | 1/1986 | Guinard | 404/65 |
| 4,601,604 | 7/1986 | Clark | 404/67 |
| 4,699,540 | 10/1987 | Gibbon | 404/67 |
| 4,784,516 | 11/1988 | Cox | 404/69 |

FOREIGN PATENT DOCUMENTS 1416576 12/1975 United Kingdom .

*Primary Examiner*—John E. Murtagh

*Attorney, Agent, or Firm*—Fleit, Jacobson, Cohn, Price, Holman & Stern

[57] ABSTRACT

A concrete joint in concrete slab structures in which the joint includes an insert that is retained in centered position in a slot or recess formed in the upper surface of a concrete slab generally in alignment with a crack or fracture line extending downwardly from the slot or recess formed in the concrete slab. The bottom of the slot or recess is provided with a seal of cementitious material which extends completely across the bottom of the slot or recess and fills the crack or fracture line with the lower edge of the insert being inserted partially into the cementitious seal which is in the form of a quick setting sand and cement mixture which has high compression strength and low tensile strength and which will adhere to concrete surfaces but will not adhere to the insert. The space above the bottom seal on each side of the insert is then filled with a filler of an epoxy or similar material which encapsulates the spring clips and fills the slot or recess on both sides of the insert.

12 Claims, 1 Drawing Sheet

CONCRETE JOINT WITH SPRING CLIP RETAINED INSERT AND BOTTOM SEAL

BACKGROUND OF THE INVENTION

1. Field of the Invention

This invention relates to a concrete joint in concrete slab structures in which the joint includes an insert that is retained in centered position in a slot or recess formed in the upper surface of a concrete slab generally in alignment with a crack or fracture line extending downwardly from the slot or recess formed in the concrete slab. The bottom of the slot or recess is provided with a seal of cementitious material which extends completely across the bottom of the slot or recess and fills the crack or fracture line with the lower edge of the insert being inserted partially into the cementitious seal which is in the form of a quick setting sand and cement mixture which has high compression strength and low tensile strength and which will adhere to concrete surfaces but will not adhere to the insert. The space above the bottom seal on each side of the insert is then filled with a filler of an epoxy or similar material which encapsulates the spring clips and fills the slot or recess on both sides of the insert.

2. Description of the Prior Art

My prior Pat. No. 4,875,802 issued Oct. 24, 1989 for Installational Concrete Joint Insert and Method of Preventing Edge Spalling discloses a solution to edge spalling of expansion joints in concrete slabs and discusses the existing problems and provides a solution to those problems. The disclosure in the above-mentioned patent and the prior art made of record therein are incorporated herein by reference thereto. The disclosure in the aforementioned patent and the prior art of record therein does not include spring clips for retaining the insert in position as disclosed in this application and does not disclose a quick set cement and sand seal for the bottom of the slot or groove which precludes the epoxy type filler from migrating into the crack or fracture line which would bond the adjacent concrete surfaces with such rigidity that the edge of the concrete joint could "refracture" by a fracture line extending from the surface of the concrete slab structure to a crack or fracture line below the slot or recess at a position laterally spaced from the side edges of the slot or recess in the concrete slab.

SUMMARY OF THE INVENTION

An object of the present invention is to provide a concrete joint in a concrete slab structure that will prevent edge spalling by the formation of a slot or recess in the form of a groove in the upper surface of the concrete slab structure that is centered in relation to a crack or fracture line with the bottom of the slot or recess being filled with a quick setting cement and sand seal which has high compressive strength and low tensile strength and which will adhere to the concrete together with an insert of resilient material such as plastic, rubber or other elastomeric material with spring clips retaining the insert centralized in the slot or recess with the lower edge of the insert embedded in the bottom seal thereby enabling a filler or laminant to completely fill the slot or recess above the bottom seal on both sides of the insert with the bottom seal preventing the filler or laminant of epoxy material from migrating into the crack or fracture below the slot or recess thus preventing the filler material from rigidly bonding to opposite surfaces of the crack or fracture line which could then cause refracturing of the concrete slab along a fracture line outwardly of the slot or recess.

Another object of the invention is to provide a concrete joint in accordance with the preceding object in which the insert is relatively narrow as compared to the width of the slot or recess in the concrete slab structure and the spring clips ar in the form of flat leaf springs having a portion engaged over a top or bottom edge of the insert and angled legs that engage the facing surfaces of the slot or recess to retain the insert in a vertical position and centralized in the slot or recess.

A further object of the invention is to provide a concrete joint in accordance with the preceding objects which can be utilized when a concrete slab structure is being formed or used to repair a cracked concrete slab in an efficient and effective manner that will prevent edge spalling of the joint and also prevent refracture around the joint.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
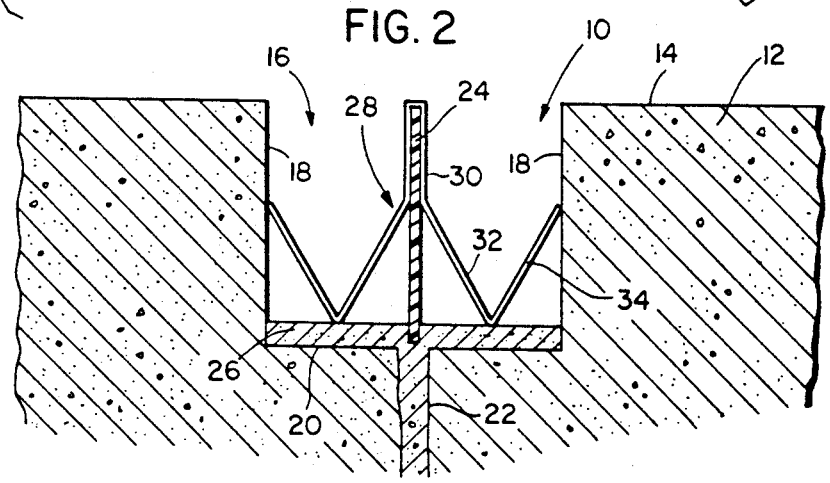
FIG. 2 is a transverse, sectional view, on an enlarged scale, taken substantially upon a plane passing along section 2—2 on FIG. 1 illustrating the association of the components of the concrete joint.
Figure 3:
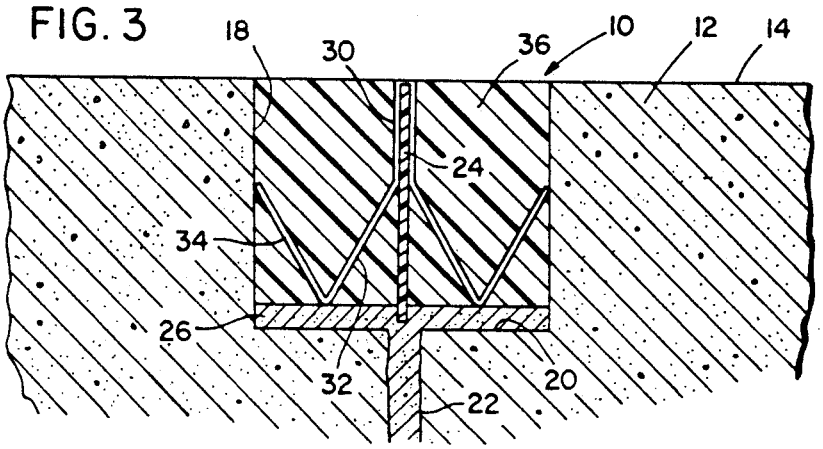
FIG. 3 is a sectional view similar to FIG. 2 but illustrating the epoxy filler or laminant completely filling the slot or recess above the bottom seal.

Referring now specifically to the drawings, the concrete joint of the present invention is generally designated by reference numeral 10 and is incorporated into a concrete slab structure 12 which includes generally planar upper surface 14 which receives moving impact loads such as wheels of a forklift truck or the like. The concrete joints 10 are formed in the concrete slab when it is being formed or the joint can be formed in a concrete slab structure after it has been been in use and a crack has occurred due to shrinkage or other causes. The joint 10 includes a slot or recess 16 defined by generally parallel, vertical and spaced walls 18 and a generally horizontal bottom 20. As illustrated in FIGS. 2 and 3, the concrete slab already has a crack 22 formed therein which would occur due to shrinkage or other causes and the slot or recess 16 is formed with the existing fracture or crack 22 generally in the center of the slot or recess 16. If the slot or recess 16 is merely filled with an epoxy filler or laminant, it will migrate into the fracture 22 and rigidly adhere to the surfaces thereof as will as being rigidly adhered to the surfaces 18 and 20 of the slot or recess 16. As disclosed in the aforementioned prior patent, an insert 24 is positioned in the slot or recess with the insert being of resilient or elastomeric material to enable expansion and contraction of the concrete joint and, as disclosed in the prior patent, the insert can be securely adhered along one surface thereof to the filler but not securely adhered along the other surface thereof to enable expansion and contraction of the concrete joint. However, if the epoxy filler migrates under the insert and fills any crack 22 which may exist, the concrete joint no longer will be an expansion or contraction joint since the epoxy filler then rigidly connects the surfaces. This can result in a refracture of the concrete slab structure by a crack forming outside of the joint 16.

Figure 1:
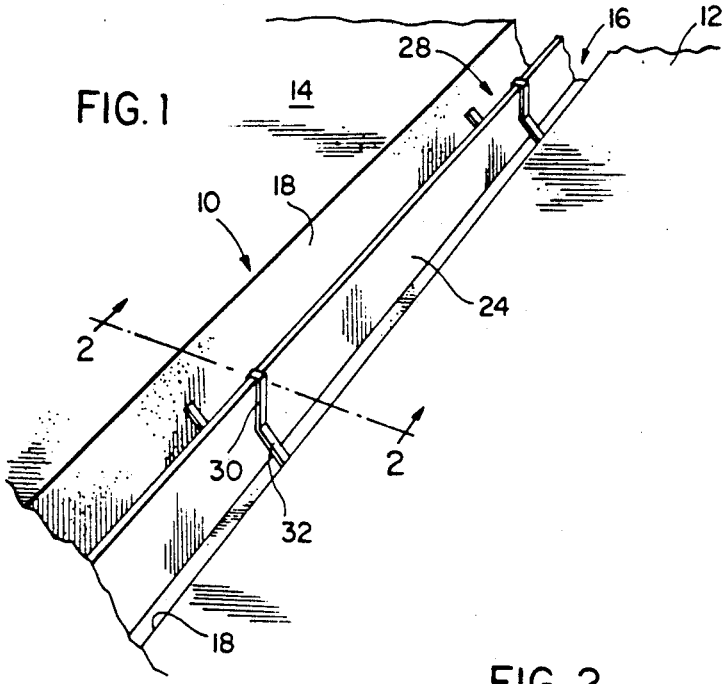
FIG. 1 is a perspective view of a concrete joint with the insert, spring clips and bottom seal in place prior to filling the slot or recess with a filler or laminant.

In order to prevent the filler from migrating under the insert 24, a bottom seal material 26 is poured into the slot or recess 16 with the bottom seal material 26 extending completely across the bottom surface 20 of the slot or recess and filling any crack or fracture line 22 which may extend downwardly therefrom as illustrated in FIG. 2. The bottom edge of the insert 24 is embedded into the upper surface of the bottom seal 26 so that when the bottom seal 26 hardens, it will form a complete seal for the bottom of the slot or recess 16 and prevent any epoxy filler or laminant from migrating downwardly into the crack or fracture line 22 and prevent the epoxy or laminant from migrating under the insert 24. The bottom seal 26 is a quick setting cementitious mixture of sand and cement which will harden in less than an hour. This material will adhere to the concrete and has very high compressive strength but very low tensile strength. FIGS. 1 and 2 illustrate a typical installation of the bottom seal and insert 24 with it being noted that the configuration of the fracture or crack 22 may be more irregular than shown in that the upper portions of the crack may diverge outwardly and the crack may not have a substantially constant width as shown.

Figure 4:
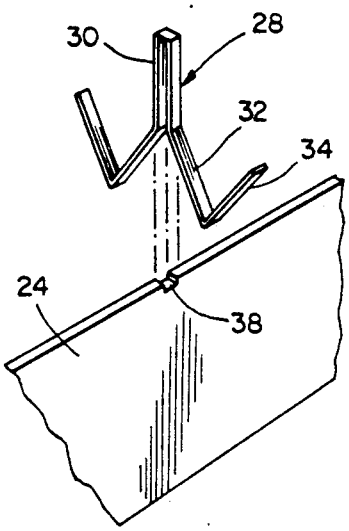
FIG. 4 is a fragmental, perspective view of the insert and a spring clip illustrating the association of these components.

The insert 24 is held in vertical position and centralized in the slot or recess 16 by the use of a plurality of spring clips generally designated by reference numeral 28 which are in the form of flat leaf springs including a generally narrow U-shaped central portion 30 having outwardly flared leg portions 32 at the ends of the legs of the U-shaped portion 30 with the outwardly flared portions including angulated terminal end portions 34 as illustrated in FIGS. 2–4 with the U-shaped portion 30 receiving the insert therein as illustrated in FIGS. 2 and 3 so that the terminal ends of the end portions 34 will engage the opposing surfaces 18 of the recess 16 and be deflected inwardly in a manner enabled by the resilience of the spring clips in order to centralize the insert in the slot or recess and to retain the insert 24 in a vertical orientation. The spring clips 28 may be constructed of spring steel or other resilient material including plastics having memory characteristics since it only necessary to support the insert 24 until the filler or laminant 36 is poured into the slot or recess 16 and permitted to harden or cure with the filler material 36 being an epoxy or equivalent material which will completely fill the space above the bottom seal 26 as illustrated in FIG. 3.

The spring clips 28 may be inserted downwardly over the top edge of the insert with the top edge of the insert optionally including a notch 38 to receive the bight portion of the U-shaped portion 30 of the spring clip 28. Also, the spring clips may be inverted and receive the bottom edge of the insert 24 with the spring clip acting in the same manner or spring clips may be provided on both the bottom edge and the top edge of the insert to provide more stability for both top and bottom edges of the insert.

The surfaces of the insert may be constructed so that either one or both side surfaces of the insert will not adhere securely to the filler or laminant as disclosed in the above-mentioned prior patent to assure that any crack which may occur due to further shrinkage will not cause refracture of the concrete slab outwardly of the slot or recess. The bottom seal 26 includes a mixture of quick setting cement and sand which effectively supports loads due to high compressive strength but, due to low tensile strength, if the concrete slab crack or fracture increases, the bottom seal material, even though hardened, will not rigidly secure the adjacent surfaces of the concrete slab in a manner that would cause the concrete slab to refracture outside of the region of the slot or recess 16.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A joint in a concrete slab structure having an elongated recess formed in the upper surface thereof with the recess including a bottom surface spaced below the upper surface of the concrete slab structure and opposed side surfaces, an insert positioned in the recess and extending generally vertically in the recess with the insert including an upper edge generally aligned with the upper surface of the concrete slab structure and a lower edge spaced bellow the upper surface of the concrete slab structure, a filler in the form of a bonding material filling the space of the recess on both sides of the insert, the improvement comprising seal means completely covering the bottom surface of the recess with the bottom edge of the insert embedded into the seal means to prevent filler material from migrating under the insert, said seal means being a hardenable material with the bottom edge of the insert embedded into the seal means prior to the seal means becoming set thereby preventing the filler material from connecting the opposed side surfaces of the recess to enable relative movement of slab structure without fracturing.

2. The joint as defined in claim 1, wherein said seal means, when hardened, will have high compressive strength but low tensile strength thereby preventing the formation of a crack outwardly of the recess by rigidly connecting the adjacent surfaces of an existing crack.

3. The joint as defined in claim 1 wherein the slab structure is subject to an existing crack or a crack formed by later contraction which extends downwardly from the bottom surface of the recess, said seal means filling any existing crack and formed of material, when hardened, having high compressive strength and low tensile strength less than the tensile strength of the concrete slab structure too prevent refracturing of the concrete slab structure during relative movement of the slab structure on opposite sides of the recess which could occur if the seal means bonded to the surfaces of a crack had a tensile strength in excess of the tensile strength of the concrete slab structure.

4. The joint as defined in claim 3 wherein said seal means is a quick-setting cementitious material completely covering the bottom surface of the recess with the bottom edge of the insert penetrating into an upper surface of the seal means with the lower edge of the insert terminating in spaced relation to the bottom surface of the recess to prevent migration of the filler under the insert, the tensile strength of the connection between the filler and insert being less than the tensile strength of the connection between the filler and the opposed side surfaces of the recess in which it is in contact with being less than the tensile strength of the concrete slab structure thereby preventing refracturing of the concrete slab structure during relative movement of the concrete slab structure.

5. A joint in a concrete slab structure having an elongated recess formed in the upper surface thereof with the recess including a bottom surface generally parallel to the top surface of the concrete slab structure and subject to a crack extending downwardly from the bottom surface of the recess, an insert positioned in the recess and extending generally vertical from the bottom surface of the recess with the insert including an upper edge generally aligned with the upper surface of the concrete slab structure and a filler in the form of a bonding material filling the space of the recess on both sides of the insert, the improvement comprising seal means completely covering the bottom surface of the recess with the bottom edge of the insert engaging the seal means to prevent filler material from migrating under the insert, means engaged with the insert and opposed surfaces of the recess to support the insert in vertical position and centralize the insert in the recess, said means supporting the insert including a plurality of spring clips connected to the insert at longitudinally spaced points and engaging the opposed side surfaces of the recess.

6. The joint as defined in claim 5 wherein each of said spring clips is constructed of resilient, flat leaf spring material including a central U-shaped portion to frictionally and resiliently engage opposed surfaces of the insert, outwardly diverging legs connected to the U-shaped portion and angulated end portions engageable with the opposed surfaces of the recess when inserted into the recess along with the insert thereby supporting the insert in vertical position and in mutually spaced relation to the opposed side surfaces of the recess.

7. The joint as defined in claim 6 wherein said seal means is a material that will fill any existing crack communicating with the bottom surface of the recess to prevent migration of the filler material into the crack.

8. The joint as defined in claim 7 wherein said seal means is a hardenable cementitious material.

9. The joint as defined in claim 8 wherein said cementitious seal means includes a mixture of quick setting cement and sand.

10. The joint as defined in claim 9 wherein said quick setting cement and sand, when hardened, will have high compressive strength but low tensile strength thereby preventing the formation of a crack outwardly of the recess by rigidly connecting the adjacent surfaces of any existing crack.

11. A joint in a concrete slab structure having an elongated recess formed in the upper surface thereof with the recess including a bottom surface generally parallel to the top surface of the concrete slab structure, ann insert positioned in the recess and extending generally vertical from the bottom surface of the recess with the insert including an upper edge generally aligned with the upper surface of the concrete slab structure and a filler in the form of a bonding material filling the space of the recess on both sides of the insert, the improvement comprising means centering said insert in the recess and supporting the insert in vertical position, said means supporting the insert including a plurality of spring clips connected to the insert at longitudinally spaced points and engaging opposed surfaces of the recess, each of said spring clips being constructed f resilient, flat leaf spring material including a central U-shaped portion to frictionally and resiliently engage the opposed surfaces of the insert, outwardly diverging legs connected to the U-shaped portion and angulated end portions engageable with the opposed surfaces of the recess when inserted into the recess along with the insert thereby supporting the insert in vertical position and in mutually spaced relation to the opposed surfaces of the recess.

12. The method of forming a joint between adjacent concrete slab structures consisting of the steps of forming a recess extending transversely of the upper surface of adjacent concrete slab structures, completely covering the bottom surface of the recess with a hardenable seal means having a tensile strength, when hardened, less than the tensile strength of the concrete slab structure, inserting an insert into the recess in a generally vertical position with the lower edge of the insert being embedded into the seal means prior to the seal means hardening to isolate spaces on opposite sides of the insert, and filling the spaces on opposite sides of the insert with a filler that will bond to the concrete slab structures with the upper edge of the insert extending to at least the upper surface of the filler with the filler and insert bonded having a tensile strength less than the tensile strength of the concrete slab structures to prevent the concrete slab structures from refracturing during relative movement.

* * * * *